US007183915B2

(12) United States Patent
Bartholf et al.

(10) Patent No.: US 7,183,915 B2
(45) Date of Patent: Feb. 27, 2007

(54) WIRELESS ATM SECURITY SYSTEM

(75) Inventors: Joel Bartholf, Macon, GA (US); Michael J. Grajewski, Pottstown, PA (US); Mitchell Lee Ingle, Stockbridge, GA (US)

(73) Assignee: 3SI Security Systems, Inc., Exton, PA (US)

( * ) Notice: Subject to any disclaimer, the term of this patent is extended or adjusted under 35 U.S.C. 154(b) by 124 days.

(21) Appl. No.: 10/912,392

(22) Filed: Aug. 5, 2004

(65) Prior Publication Data

US 2006/0028341 A1 Feb. 9, 2006

(51) Int. Cl.
*G08B 13/14* (2006.01)

(52) U.S. Cl. ..... 340/570; 340/568.7

(58) Field of Classification Search ..... 340/568.1, 340/568.7, 572.1, 541, 545.1, 546, 999, 570; 109/21, 31

See application file for complete search history.

(56) References Cited

U.S. PATENT DOCUMENTS

| | | | | |
|---|---|---|---|---|
| 3,725,893 | A * | 4/1973 | Malta et al. | 340/570 |
| 5,059,949 | A | 10/1991 | Caparoni et al. | |
| 5,091,713 | A * | 2/1992 | Horne et al. | 340/541 |
| 5,440,107 | A * | 8/1995 | Phillips | 235/10 |
| 5,512,877 | A * | 4/1996 | Gels et al. | 340/570 |
| 5,598,793 | A | 2/1997 | Lopez, Jr. | |
| 5,732,638 | A | 3/1998 | Van Lint | |
| 5,915,802 | A | 6/1999 | Siler | |
| 5,952,920 | A | 9/1999 | Braddick et al. | |
| 6,191,690 | B1 * | 2/2001 | Mukogawa | 340/568.7 |
| 6,225,902 | B1 * | 5/2001 | Gahan | 340/540 |
| 6,400,276 | B1 * | 6/2002 | Clark | 340/640 |
| 6,552,660 | B1 | 4/2003 | Lisowski | |
| 6,568,336 | B2 | 5/2003 | Van Lint | |
| 6,750,767 | B2 * | 6/2004 | Besnard | 340/539.1 |

(Continued)

FOREIGN PATENT DOCUMENTS

| | | |
|---|---|---|
| EP | 580297 | 1/1994 |

(Continued)

OTHER PUBLICATIONS

Pat. Abstracts of Japan vol. 2003 No. 9, Sep. 3, 2003.

(Continued)

*Primary Examiner*—Daniel Wu
*Assistant Examiner*—Jennifer Mehmood
(74) *Attorney, Agent, or Firm*—RatnerPrestia

(57) ABSTRACT

A security system for use in an enclosure which may be an ATM. The security system includes a first electronic module housed within the enclosure and at least one removable container for storing valuables. A second electronic module is housed within the removable container. The modules communicate with each other wirelessly within the enclosure. The first module includes one or more inputs for receiving an output of at least one sensor for sensing an activity predetermined to indicate a security threat, a first logic circuit in communication with the inputs, and a first wireless communication device connected to the logic circuit. The second electronic module includes a second wireless communication device; a second logic circuit connected to the second communication device; and at least one output for sending an activation signal to a theft deterrent device in response to a pre-programmed sequence of events, including at least one communication from the first module.

17 Claims, 2 Drawing Sheets

U.S. PATENT DOCUMENTS

2003/0122673 A1 7/2003 Anderson

FOREIGN PATENT DOCUMENTS

| | | | |
|---|---|---|---|
| GB | 2 353 067 | A | 2/2001 |
| GB | 2 359 890 | A | 9/2001 |
| GB | 2 360 327 | A | 9/2001 |
| JP | 2003 141597 | | 5/2003 |
| WO | WO 98/11714 | | 3/1998 |
| WO | WO 99/35622 | | 7/1999 |
| WO | WO 01/06464 | A1 | 1/2001 |
| WO | WO 01/29786 | A1 | 4/2001 |
| WO | WO 01/69026 | A1 | 9/2001 |

OTHER PUBLICATIONS

European Search Report App. No. 05254672.8—PCT Oct. 20, 2005 (3 pp.).

* cited by examiner

WIRELESS ATM SECURITY SYSTEM

FIELD OF THE INVENTION

This invention relates to a security system for use in an automatic teller machine (ATM) and more particularly a wireless system for installation in an ATM for detecting unauthorized tampering with the machine and rendering currency stored in said machine unusable.

BACKGROUND OF THE INVENTION

An automatic teller machine allows persons to acquire cash by interacting with the machine, e.g., by inserting a bank card associated with a particular bank account or credit account and entering a personal identification number (PIN). A typical automatic teller machine is a cabinet with a front portion providing a terminal screen, key pad, and various slots for conducting interaction and transactions with a user. The cabinet also includes a hinged door providing access to the interior of the cabinet. The cabinet itself is a high security enclosure with substantial structure and locking mechanisms for the access door. Within the interior compartment, there is housed a variety of components including electronic circuitry, and a stack of drawers or cassettes holding a cash inventory and providing a vault portion of the automatic teller machine.

Early automatic teller machines were typically incorporated into a wall structure, e.g., the exterior wall of a bank, and the public had access only to a front panel of the automatic teller machine. Bank employees could access the back side of the automatic teller machine from inside the bank to perform such tasks as restocking the cash inventory and taking deposits from the vault portion of the automatic teller machine. Automatic teller machines have evolved significantly, however, and are now found in a variety of locations such as at grocery stores, gas stations, shopping malls, small convenience stores, and the like. Furthermore, automatic teller machines are now often stand-alone structures, i.e., not incorporated into a wall structure.

The presence of substantial amounts of unattended cash in such machines, particularly in stand alone machines provides a great temptation to thieves who do not hesitate to rip apart the machines either on location or after they have removed the whole machine to a secure location, in order to access the cash stored within the cassettes.

Modern ATM equipment typically contains sensors that detect whether the equipment is attacked and warn a central location. False alarms occur frequently often due to improper use or activity by bank personnel. Even if the alarm is a proper alarm, this communication is often ineffective because by the time someone reacts to the alarm, the thieves have either torn the machine apart or removed it from location and obtained access to the cash within. Accordingly, unattended, and especially stand-alone automatic teller machines are particularly vulnerable to theft. There is therefore, need for a security system for use in protecting ATMs by discouraging thieves from attacking ATMs, particularly unattended stand alone units. Because there are at present very large numbers of ATMs already in place, there is an even greater need for a system that is inexpensive, reliable, and that can be easily retrofitted into existing equipment, requiring minimal modification of the ATM for installation.

SUMMARY OF THE INVENTION

It is therefore an object of the present invention to provide a security system for an automatic teller machine wherein such system is able to determine whether a machine is being attacked and if so, when certain predetermined conditions are met, to render the cash contained in the cassettes unusable as, for example, by releasing a marking dye to stain the bank notes.

It is a further object of the present invention to provide such security system in a format and cost that permits retrofitting existing ATMs with such system.

To achieve these and other objects, and in view of its purposes, the present invention provides a security system for use in an apparatus comprising a cabinet having at least one removable container secured within the cabinet, the removable container for storing valuables therein, the security system comprising:

(1) a first electronic module housed within the cabinet, the first module comprising:
   (a) one or more inputs for receiving an output of at least one sensor sensing activity predetermined to indicate a security threat,
   (b) a first logic circuit in communication with said one or more inputs and
   (c) a first wireless communication device connected to said logic circuit; and
(2) a second electronic module housed within the container comprising:
   (a) a second wireless communication device;
   (b) a second logic circuit connected to said second wireless communication device; and
   (c) at least one output for sending an activation signal to a theft deterrent device in response to a pre-programmed sequence of events including at least one communication from the first controller.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Figure 1:
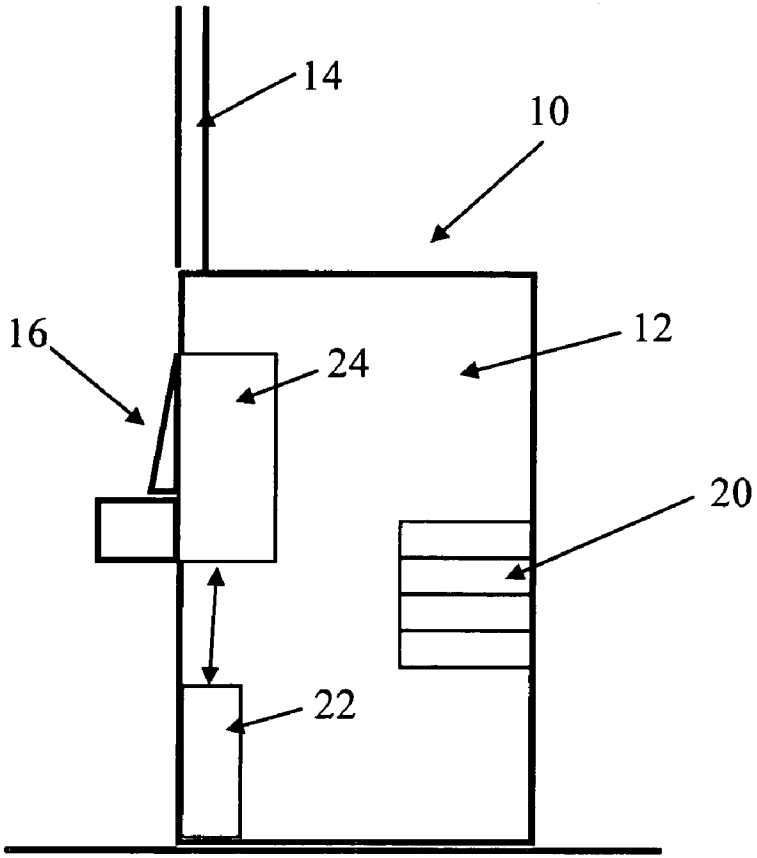
FIG. 1 is a schematic representation of an elevation cross section of a typical ATM machine identifying various elements of such machine pertinent to the present invention.

Referring now to the drawing, wherein like reference numerals refer to like elements throughout, FIG. 1 shows a typical automatic teller machine, 10. In order not to unduly complicate the description of the present invention, only elements related to the present invention are shown, even though ATMs are complex machines with a plurality of functions. Furthermore the elements shown are elements that are typically found in most, if not all, ATMs regardless of manufacturer or model. The ATM 10 comprises an enclosure 12 forming a container housing numerous elements needed for the operation of the ATM. Such enclosure may be located within a building wall structure 14 or may be free standing. The ATM wall may be heavy gauge metal or plastic. Within the enclosure there are typically an interface electronic circuitry and associated devices for communicating with a customer 16 and with a remote central computer (not shown) usually located at a Bank branch or central office. Such communication with such central computer is most often through a telephone line and modem arrangement.

Still within the enclosure there is located at least one, and usually four or more, cash containers 20 (hereinafter referred to as "cassettes"). The cassettes 20 are preferably not integral to a particular ATM, but are removable and replaceable so that empty cassettes are removed and replaced with filled cassettes during servicing of the ATM without need for handling loose cash during the servicing process. The cassettes are designed to co-operate with a cash dispensing mechanism for dispensing cash to a customer using the ATM after a predetermined sequence of events, such as insertion of an ID card, proper identification of the customer, verification of the customer's credit, etc. Some of these functions occur locally in the ATM, whereas others are performed by the central computer.

Most ATMs further include a number of sensors schematically represented by block 22. Such sensors usually provide signals indicative of certain predetermined "alarm" conditions, including but not limited to smoke, heat, seismic motion, tilting beyond an acceptable amount, movement, and the like. The sensors communicate the alarm condition to the bank central computer for further action.

The present invention uses these sensors to its advantage by placing a primary control unit (PCU) 24 within the ATM enclosure and connecting at least one of the sensors to the PCU. To that effect, the PCU shown in block diagram in FIG. 2, comprises a plurality of appropriate inputs 26 for receiving input data or status information from alarm sensors, preferably alarm sensors already in existence within the ATM enclosure.

The PCU also comprises a central processing unit (CPU) 26 and an associated, preferably non volatile, memory 28, and can be programmed to remember and respond to different sensor inputs in desired predetermined ways. The PCU further includes a wireless interface. Such interface typically comprises a radio transmitter 30 connected to the CPU 26 which permits it to transmit a control radio signal to a receiver located preferably in close proximity therewith, usually within the enclosure. Preferably the PCU wireless interface includes a transceiver rather than a transmitter so that signals may not only be transmitted by the PCU, but may be received by the PCU as well.

The PCU may also include one or more inputs 32 for receiving remote signals, such as, for example, signals from a modem. The PCU may also include an integral modem, and be provided with input connections 34 such as RS 232 or any other industry accepted interface connectors for allowing signals originating from outside the PCU to be received and processed by the PCU, as well as for signals originating in the PCU to be transmitted to elements outside the PCU.

Optionally the PCU may include a plurality of integral sensors, such as a tilt sensor 37 which may be a mercury trip switch providing an open/close status, a motion sensor 38 such as an accelerometer, a smoke detector 39, etc. The PCU may also include an alarm buzzer 41.

The PCU may be connected and use the power source of the ATM or may include its own power source 43, such as a battery, or both. A voltage regulator may be used as part of the power source to provide stable voltages.

Figure 2:
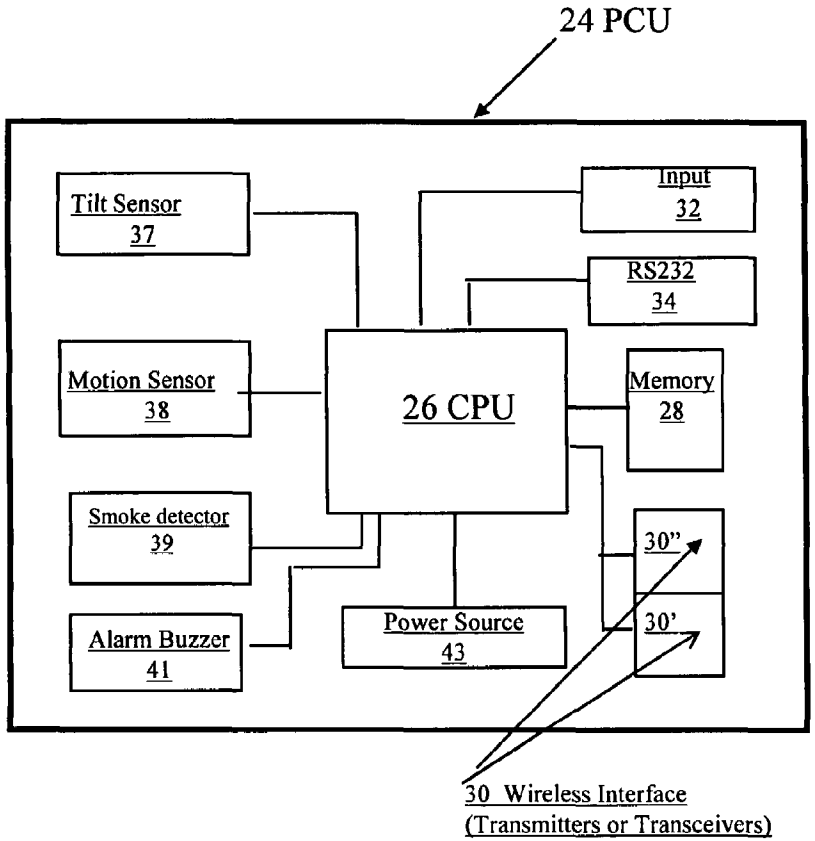
FIG. 2 is a block diagram showing the elements comprising the primary control unit (PCU).
Figure 3:
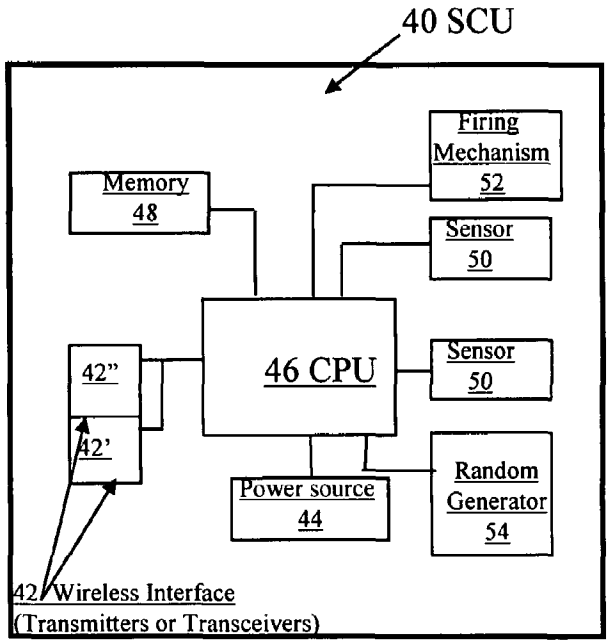
FIG. 3 is a block diagram showing the elements comprising the secondary control unit (SCU).

As shown in FIG 2. according to the present invention there is also provided one or more companion units to the PCU, referred to herein as a secondary control units 40 or SCUs. These SCUs are free standing devices intended to be placed inside a cassette. FIG. 3 shows a block diagram of one such free standing SCU. Each SCU includes a wireless interface as well, which again typically comprises a radio receiver 42, which is adapted to receive signals from the PCU transmitter 30 and upon receipt of such signals perform certain predetermined functions. As in the case of the PCU rather than a receiver the preferred embodiment of the present invention uses a transceiver as the wireless interface, thereby permitting bi-directional communication between the PCU and the SCU.

In addition to the transceiver, the SCU includes a power source 44 which typically comprises a battery and may include a voltage regulator. The SCU may also include a CPU 46 and a preferably non volatile memory 48 so that it can be programmed to perform certain functions upon receiving certain signals through the transceiver. The use of a volatile memory is preferred as it offers the added advantage of preserving a history of events for review, in cases where the system was activated.

The SCU may also include sensors 50 that sense state changes from the onboard tilt and motion and lid sensors. Such sensors permit the SCU to determine whether certain predetermined conditions have been met and certain specific action is required. Finally, associated with the SCU are a means to destroy the contents of the cassette or at least render unusable any money contained within the cassette upon command from its CPU. Such command is the result of a predetermined sequence of events occurring which generally include a command from the PCU received by radio transmission.

The means to destroy or render the cash in the cassette unusable are well known in the art and include usually some form of pyrotechnics that release an indelible dye staining the cash. U.S. Pat. Nos. 5,059,949; 5,732,638; 6,568,336; and 6,552,660, all presently assigned to the common assignee of the present invention, disclose exemplary such systems. Substantially all such devices include some means to release smoke or dye or both on command by a control unit. The SCU may include the full package of chemicals or pyrotechnics (not shown) needed to render the cash unusable or may only contain a firing mechanism 52 for activating such chemicals or pyrotechnics, which may be associated with the SCU.

In one embodiment of the invention, the security system is not installed within an ATM machine as hereinabove described, but within an enclosure used for transporting cash to different locations, including ATMs, as for example in a cash transporting vehicle. In such application, the PCU will be placed in the cargo space of the vehicle in close proximity to the cassettes. A SCU is then placed in each cassette with the cash and the cassettes are loaded in the vehicle, protecting the cash during transport to a desired destination.

In order to operate with a plurality of cassettes, in a preferred embodiment, both the PCU and the SCU central processing units are programmed to detect the presence of cassettes and address each cassette independently if necessary. For increased security, each SCU includes a random generator 54 and associated programmed instructions. The PCU typically sends a broadcast signal which is recognized by any and all SCUs within range.

A SCU responds to the broadcasted signal by emitting a randomly generated address string and storing this randomly generated address string in its memory. The address is also stored in the CPU memory of the PCU. The broadcast signal by the PCU may also include a set of programmed instructions to the SCU instructing the SCU to respond only to future PCU instructions if prefaced by the address string.

The PCU may be preprogrammed, or a set of instructions programmed into the SCU may be transmitted to the PCU, instructing the PCU to preface instructions transmitted to the SCU with the address string. Thus, extra security is provided to assure that the cassette safety provisions controlled by the SCU may only be activated by the PCU and that only the PCU has access to the SCU, because only the PCU "knows" the random generated number used as the address string.

Preferably, when more than one cassette is to be used with multiple SCUs, the programming of the PCU may include conflict resolution subroutines triggered if multiple cassette responses are received with the same random number in the address string. In such case, the PCU may continue to interrogate the cassettes until there are no longer any similar address strings present.

The PCU is further programmed with a predetermined set of instructions typically stored in the memory, the set of instructions including instructions to send a warning signal to the SCU placing the SCU to a first state of alert when any one of a number of preselected sensors associated with the enclosure and connected to the PCU emits a signal indicative of a predetermined condition. Typically such signal may be a change in the status of a switch. For example, in an ATM environment, the ATM may be equipped with sensors that detect the presence of tilt beyond a predetermined degree, or motion of the ATM, or the presence of heat above a certain level.

Activity detected by the ATM sensors may be used to initiate the transmission of a warning signal from the PCU to the SCU, placing the SCU in a first alert state. A second signal from the PCU as a result of the detection of a predetermined event, or a signal resulting from a predetermined event detectable by the SCU, may then be used to initiate the destruction of the cash within the cassette. Preferably the SCU is programmed to exit the alert state if no further signal is received from the PCU or other input within a predetermined time.

The SCU may also exit the alert stage upon command from the PCU. This command may be the result of preprogrammed set of conditions or the result of receipt by the PCU of a remote signal.

In a preferred embodiment, the command message packet sent by the PCU to the CSU may consist of an address byte, a control byte, a four byte payload and a two byte CRC (Cyclical Redundancy Check). The control byte is split into a four bit message type field and four bit message ID field. The message type defines whether the message is a data message, an acknowledge message, a negative acknowledge message or a broadcast message. The message ID is an incrementing counter maintained in the PCU and may be used for additional message validation. Depending on the type, messages may have different lengths. All messages sent from the PCU and any data messages transmitted by the SCU typically consist of the long form described above. A shorter message form is preferably used for the acknowledge (ACK) and negative-acknowledge (NAK) messages generated by the SCU, because these messages do not contain a payload.

Preferably, the SCU RF transceiver is turned on only when needed in order to minimize power consumption and extend the battery life. For a majority of the time the SCU is inactive, waking up only after some external event such as a switch closure or a periodic wake up signal from an internal timer. Use of a periodic wake up interval (i.e. 1 sec.) allows the SCU to listen for a synchronizing sequence from the PCU and to prepare to receive a message from the PCU. The synchronizing sequence may be a series of alternating zeros and ones and last longer than the periodic wake up interval of the CPU (i.e. 1.2 sec.), ensuring that the SCU will detect at least a portion of the synchronization signal.

Preferably, the synchronization sequence occurs only at the beginning of sending messages to the SCU. Subsequent messages are sent without minimal delay as long as they are sent within a preset timeout interval in the SCU. If no synchronization signal is detected within the preset timeout interval by the SCU, the SCU returns to dormant state preserving power and extending battery life.

Preferably, the transceiver used both in the PCU and the SCU is a simple on-off keying type RF transceiver utilizing AC coupling, which requires that the data be encoded without long runs of ones or zeros in order to maintain good slicing symmetry at the data recovery stage. Such type of encoding known as DC-balanced encoding. An exemplary DC-balanced encoding scheme may be used in which four bits of data are converted into six bits of data, which by design limits the runs of zeros or ones. Each data byte is therefore represented by twelve bits with no more than four bits of the same type in a row.

Functionally, the PCU is preferably programmed to sense state changes to alarms from the ATM control unit, door switch, wire mesh if installed, onboard tilt and motion switches, and includes at least one spare input for future needs. In addition it is programmed to interpret the state changes and inputs and make decision whether such changes constitute a threat.

In a preferred embodiment, the PCU includes the ability to initiate self-test from an external contact closure or on board pushbutton switch and means to display results of the self-test such as, for example, through individual LED's or a dual seven segment display.

The computer capacity of the PCU is selected sufficient to manage the communication to and from all of the SCUs. Such management includes the ability to interrogate each SCU after cassette installations to determine the ID of the cassette. In addition it is preferred that the PCU includes the ability to control audible warning devices using different tones depending on the state of the threat, and to enable a contact closure so that the remote ATM monitoring equipment will know that activation has occurred.

Optionally the PCU includes the ability to switch to a backup frequency if necessary. In such case transceivers 30 may comprise transceivers 30' and 30" and transceiver 42 may comprise transceivers 42' and 42" providing redundancy. Also optionally, the PCU computer is programmed to log events to non-volatile memory 48 for future study. Also optionally the PCU may be accessed for interrogation and programming through an RS-232 port.

The technology for implementing the aforementioned functions and the required hardware are well known in the art and readily available, therefore no further description is needed for the person skilled in the art.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A security system comprising:

a. a primary control unit for placement in an enclosed space, the primary control unit comprising:

i. a first logic circuit, ii. a first wireless communication device, and iii. at least one sensor connected to primary control unit, said sensor adapted to sense an event predetermined to indicate a security threat, and b. at least one container for storing valuables, the container for placement within said enclosed space, the container comprising a secondary control unit comprising:

i. a second logic circuit;

ii. a second wireless communication device for communicating with said first wireless communication device while both are within said enclosed space; and iii. a theft deterrent device;

wherein:

the first logic circuit is programmed to receive information from said at least one sensor and to issue wireless communication signals through said communication device in response to the received information, including command signals;

the second logic circuit is programmed to receive said wireless communication signals from said first logic circuit through said second wireless communication device, enter an active state following receipt of a first command signal and activate said theft deterrent device upon receipt of a second command signal, when both said first logic circuit and said second logic circuit are in said enclosed space.

2. The security system of claim 1, wherein said first communication device comprises a transceiver.

3. The security system of claim 1, wherein both communication devices comprise a transceiver.

4. The security system of claim 1, wherein said first logic circuit is also programmed to cause transmission of a data packet to said second logic circuit instructing said second logic circuit to immediately activate said threat deterrent device without first entering a distinct active state.

5. The security system of claim 1, wherein said first logic circuit comprises a microprocessor.

6. The security system of claim 1, wherein said second logic circuit comprises a microprocessor.

7. The security system of claim 1, wherein said primary control unit and said secondary control unit are adapted to exchange data through wireless transmission.

8. The security system of claim 1, wherein said removable container comprises a currency-containing cassette and said theft deterrent device is contained within said currency-containing cassette.

9. The security system of claim 8, wherein said theft deterrent device is connected to said secondary control unit, is adapted to be activated by said secondary control unit, and is adapted to render useless the currency contained in said cassette upon activation.

10. The security system of claim 9, wherein said theft deterrent device is adapted to release a dye to stain the currency contained in said cassette upon activation.

11. The security system of claim 1, wherein said theft deterrent is designed to render unusable valuables deposited in said container.

12. The security system of claim 1, wherein the secondary control unit also comprises one or more inputs for receiving an output of at least one sensor for sensing activity predetermined to indicate a security threat.

13. The security system of claim 12, wherein said first logic circuit is programmed to transmit a data packet comprising a first command signal to said secondary control unit causing said second logic circuit to be placed in an alert state during which detection of a predetermined event from said at least one sensor or receipt of said second command signal from said primary control unit, or both causes the secondary control unit to activate said theft deterrent device.

14. The security system of claim 1, wherein the first and second communication devices are not restricted to communication exclusively with each other.

15. The security system of claim 1, wherein the enclosed space comprises an automatic teller machine.

16. The system of claim 1, wherein the enclosed space is in a vehicle used for transporting the currency cassettes.

17. The system of claim 8, comprising an ATM-based first electronic module for communication with one or more second electronic modules located in one or more currency cassettes secured within the ATM, and further comprising a vehicle-based first electronic module for communication with one or more second electronic modules located in one or more currency cassettes located in the vehicle for transport to or from the ATM.

* * * * *